US006256815B1

(12) United States Patent
Degen

(10) Patent No.: US 6,256,815 B1
(45) Date of Patent: Jul. 10, 2001

(54) SPRING BRIDGE FOR A MATTRESS BASE

(75) Inventor: Hugo Degen, Seltisberg (CH)

(73) Assignee: Thomas Beteiligungs-und Vermogens-GmbH & Co. KG, Bremervorde (DE)

( * ) Notice: Subject to any disclaimer, the term of this patent is extended or adjusted under 35 U.S.C. 154(b) by 0 days.

(21) Appl. No.: 09/242,373

(22) PCT Filed: Sep. 17, 1996

(86) PCT No.: PCT/CH96/00320

§ 371 Date: Feb. 16, 1999

§ 102(e) Date: Feb. 16, 1999

(87) PCT Pub. No.: WO98/11807

PCT Pub. Date: Mar. 26, 1998

(51) Int. Cl.[7] ..... A47C 23/06
(52) U.S. Cl. ..... 5/236.1; 5/241; 5/237
(58) Field of Search ..... 5/236.1, 237, 239, 5/241, 242, 191

(56) References Cited

U.S. PATENT DOCUMENTS

| | | | | |
|---|---|---|---|---|
| T101,501 | * | 2/1982 | Robinson | 5/237 X |
| 984,001 | * | 2/1911 | Ingraham | 5/237 X |
| 1,511,815 | * | 10/1924 | Markow | 5/239 X |
| 3,717,886 | * | 2/1973 | Watts | 5/239 |
| 5,588,165 | | 12/1996 | Fromme . | |

FOREIGN PATENT DOCUMENTS

| | | |
|---|---|---|
| 680337 | 8/1992 | (CH) . |
| 2536898 | 4/1976 | (DE) . |
| 2703199 | 12/1977 | (DE) . |
| 2842038 | 3/1985 | (DE) . |
| 2858243 | 3/1986 | (DE) . |
| 9317114 | 1/1995 | (DE) . |
| 4337925 | 5/1995 | (DE) . |
| 0401712 | 1/1994 | (EP) . |
| 2005134 | 9/1978 | (GB) . |

* cited by examiner

*Primary Examiner*—Terry Lee Melius
*Assistant Examiner*—James M. Hewitt
(74) *Attorney, Agent, or Firm*—Selitto, Behr & Kim

(57) ABSTRACT

The spring bridge (2) includes a main, load-bearing bridge (6), which can be fitted in the frame of a mattress base, and one or more supporting elements (8) arranged thereon. The supporting elements (8) extend, preferably in the form of a sheet-like, wing-like lip, from the main, load-bearing bridge (6), in the lateral direction, transversely with respect to the longitudinal axis of the main, load-bearing bridge and project beyond the top side of the main, load-bearing bridge (6). They are designed such that their flexibility in relation to the main, load-bearing bridge counter to a bearing force, usually the locally active weight of a mattress which has been positioned on top and of a person who is resting on said mattress, is more yielding than the flexibility of the main, load-bearing bridge itself. The spring-bridge construction proposed, on the one hand, permits cost-effective production of a spring-bridge grille and, on the other hand, nevertheless provides the functions which are necessary for a high degree of lying comfort, in particular locally progressively adapting spring properties.

23 Claims, 5 Drawing Sheets

SPRING BRIDGE FOR A MATTRESS BASE

FIELD OF THE INVENTION

The present invention relates to a spring bridge for a mattress base designed as a spring-bridge grille.

BACKGROUND OF THE INVENTION

Spring-bridge grilles are used in a variety of different designs as underspringing for an upholstered support, for example a seat cushion or a mattress. In this case, the flexible mounting of the spring bridges has proven very successful, in particular for beds with a high degree of lying comfort which is optimum from health aspects.

According to the prior art, the flexibility of these spring bridges is achieved by elastic suspension of the individual spring strips on the frame, and different variants of special elastic supporting bodies for the spring strips have been disclosed for this purpose, these being described, interalia, in German Patents 25 36 898 and 28 42 038.

German Utility Model G 93 17114 has disclosed another type of spring bridge, in the case of which the flexibility is achieved by a plurality of the spring elements being arranged on a main, load-bearing bridge.

The abovementioned spring bridges can be used to construct spring-bridge grilles which—in conjunction with the mattress—adjust in optimum fashion to the body of the person lying thereon, the nature and lying position of which mean that the person's body exerts locally very different and constantly changing bearing forces.

However, these convincing advantages, in relation to the lying comfort, of the previously known constructions are paired with certain disadvantages in relation to the production costs. Thus, in particular the elastic supporting bodies or spring elements which are required in these types of spring-bridge grilles, and are usually produced from rubber and are of relatively complicated construction, constitute cost-intensive additional parts.

SUMMARY OF THE INVENTION

The main object of the present invention is thus to propose a spring-bridge construction which, on the one hand, permits cost-effective production of a spring-bridge grille and, on the other hand, nevertheless has the functions which are necessary for a high degree of lying comfort, in particular locally progressively adapting spring properties.

Accordingly, the spring bridge comprises a main, load-bearing bridge and at least one flexible supporting element, which is arranged thereon and is of sheet-like design. The main, load-bearing bridge may be fitted on the side parts of a mattress base and, ultimately, thus absorbs the load. The supporting element extends, in the lateral direction, transversely with respect to the longitudinal axis of the main, load-bearing bridge and, at least in some regions, extends upwards beyond the top side of the main, load-bearing bridge. It is designed such that it is more flexible and/or elastic than the main, load-bearing bridge itself.

The supporting element is preferably designed such that, when loaded by a bearing force (normally the locally acting weight of a mattress which has been positioned on top and of a person who is resting on said mattress), it is bent downwards, a region which is closer to the main, load-bearing bridge being rotated by not more than the same angle as a more remote region.

In a preferred embodiment, the supporting element is in the form of a wing-like lip which extends obliquely upwards from the main, load-bearing bridge. Expediently, in each case at least one supporting element is arranged on both longitudinal sides of the main, load-bearing bridge.

Since the flexibility of the supporting element is more yielding than that of the main, load-bearing bridge, said supporting element deforms even under a lightweight load, whereas, the main, load-bearing bridge only yields under a greater load. In other words, different, accumulative load-bearing forces, and thus progressively adapting spring properties, are obtained.

This achieves local elasticity or spring action, and in a certain sense also a capacity for articulation, of the spring bridge, to be precise without special, flexible suspension. Spring bridges designed according to the invention thus inherently have compliance and spring properties, which are necessary for lying comfortably, transversely with respect to the longitudinal axis of the spring bridge.

The flexibility or elasticity of the supporting element in relation to the main, load-bearing bridge can be suitably adjusted by an appropriate selection of material and cross-sectional dimensions. As tests have shown, it is usually appropriate for a mattress base of a bed for a person of normal weight if the supporting element can be pushed down onto the plane of the top side of the main, load-bearing bridge by a local bearing force of approximately 20 Newtons.

In the case of special embodiments, the supporting element may be divided up into a plurality of segments in the longitudinal direction of the spring bridge or it is possible for a plurality of supporting elements to be arranged in the manner of segments, this further improving the locally differently adaptable spring action.

Preferred embodiments of the supporting elements and of the main, load-bearing bridge are designed such that they can be assembled without tools and are suitable for self-assembly.

A further advantage of spring bridges according to the invention relates to the ventilation of a mattress which is located thereon. By virtue of the supporting elements extending upwards beyond the top side of the main, load-bearing bridge, the mattress, at least in the non-loaded or only partially loaded state, does not rest fully on the spring bridges; rather, there is an interspace by way of which the underside of the mattress is ventilated, even in the region of the spring bridges, and evaporation of the moisture arising in the mattress is facilitated. In addition, if a person who is resting on the mattress shifts, this results in a pumping effect in the interspaces, and this pumping effect further improves the ventilation. Since the ventilation problem, which, in the case of spring strips butting flat against the mattress, restricts the width of said spring strips to a certain maximum, is solved in this way, it is also possible for the spring bridges to be wider, so that a smaller number suffices for the purpose of forming a grille.

The abovementioned advantages are achieved extremely cost-effectively by the spring-bridge design according to the invention. Costly supporting bodies for the suspension of the spring bridges, as well as special devices for ventilating the mattress on the underside, are dispensed with. Furthermore, since it has been possible to dispense with special supporting bodies, the operation of assembling a spring-bridge grille is simplified to a considerable extent.

It is expedient and preferred for the main, load-bearing bridge and supporting element to be produced from plastic, either in one piece or as separate parts. Single-piece designs do away with additional fastening devices and assembly steps. On the other hand, separate parts make it possible to use different materials, for example materials with different degrees of elasticity or, for example, a glass-fiber reinforced plastic for the main, load-bearing bridge. Moreover, separate parts ensure straightforward separation of materials in the event of subsequent disposal.

A plurality of separate supporting elements may be provided on a main, load-bearing bridge. This advantageously makes it possible for the supporting elements to be arranged in a variable manner, for example for more to be arranged in the case of spring bridges in the regions of greater loading (for example where the person's bottom is located) than in the regions of lesser loading.

BRIEF DESCRIPTION OF THE DRAWINGS

In order further to explain the invention, a number of exemplary embodiments are described hereinbelow with reference to the attached drawings, in which.

DETAILED DESCRIPTION OF THE DRAWINGS

Figure 1:
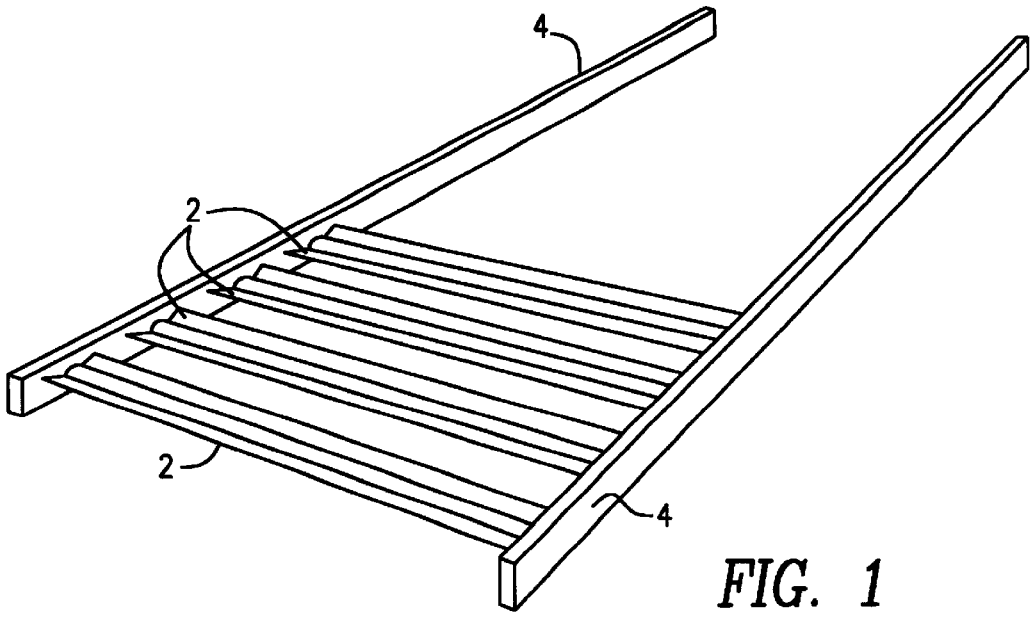
FIG. 1 shows a diagram of a spring-bridge grille with spring bridges according to the invention.
Figure 2:
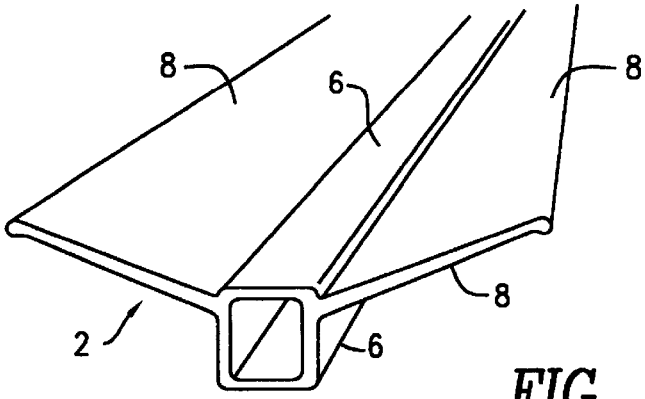
FIG. 2 shows a perspective illustration of one exemplary embodiment of a spring bridge according to the invention, the illustration being broken away towards the rear in the longitudinal direction of the spring bridge.
Figure 3:
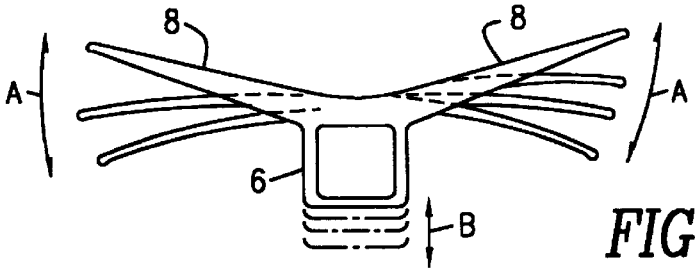
FIG. 3 shows a front view of the spring bridge from FIG. 2, with different bending positions of the supporting elements and of the main, load-bearing bridge being indicated schematically.

The spring bridge which is illustrated in FIGS. 1 to 3, and is designated overall by 2, has the basic elements of the invention. According to FIG. 1, a number of spring bridges 2 are fitted in a frame, in this case comprising two longitudinal members 4, with the purpose of forming a mattress base.

Each spring bridge 2 comprises a main, load-bearing bridge 6, which is designed as a hollow profiled bar of essentially rectangular cross section, and two supporting elements 8, which are each arranged on one longitudinal side of the main, load-bearing bridge 6. The supporting elements 8 are integrally formed on the main, load-bearing bridge 6 and extend obliquely upwards in the form of sheet-like, wing-like lips from the main, load-bearing bridge 6, in the lateral direction, transversely with respect to the longitudinal axis of the main, load-bearing bridge in cantilever fashion and, with the exception of the region which directly adjoins the main, load-bearing bridge 6, the supporting elements 8 project beyond the top side of the main, load-bearing bridge 6.

On account of their sheet-like design and small thickness, the supporting elements 8 have a comparatively high degree of flexibility or elasticity in relation to the main, load-bearing bridge 6, said flexibility or elasticity in any case being more yielding than the flexibility or elasticity of the hollow profile of the main, load-bearing bridge 6. Therefore, under the action of a small bearing force, it is mainly the supporting elements 8 which are bent and pushed down onto the plane of the top side of the main, load-bearing bridge 6 and, appropriately, further downwards still, as is indicated by the different positions along the arrows A in FIG. 3, whereas the main, load-bearing bridge 6 yields only to a slight extent (arrow B). It is only when the bearing force is greater and, once the supporting elements 8 have been pushed down, can also act directly on the main, load-bearing bridge 6, that the latter is also deformed to a greater extent.

Conversely, different, accumulative load-bearing forces thus act in the spring bridge 2 counter to a bearing force; the spring bridge therefore has the desired, progressively adapting spring properties. Moreover, the supporting elements 8 can be pushed down differently in different sections in the longitudinal direction of the spring bridge, with the result that locally different loading states are possible in this direction too. It is likewise possible for the supporting element 8 on one side of the main, load-bearing bridge to be pushed further downwards than the supporting elements 8 on the other side, as a result of which an inclined bearing surface overall in relation to the horizontal is obtained and, in its active position, the spring bridge 2 is tilted, as it were, in an articulated manner.

Figure 4:
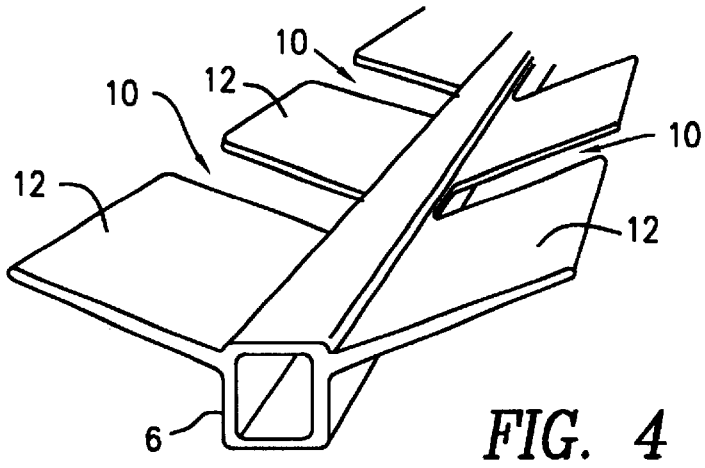
FIGS. 4–12 show, illustrations analogous to FIG. 2, further exemplary embodiments of spring bridges according to the invention.

The exemplary embodiment of FIG. 4 corresponds in general terms to the previously described exemplary embodiment. In this case, however, the two supporting elements are divided up into a variety of segments 12 by cutouts 10 in the longitudinal direction of the spring bridge 2. The segments 12 can thus be adapted differently in local areas to a yet greater extent.

Figure 5:
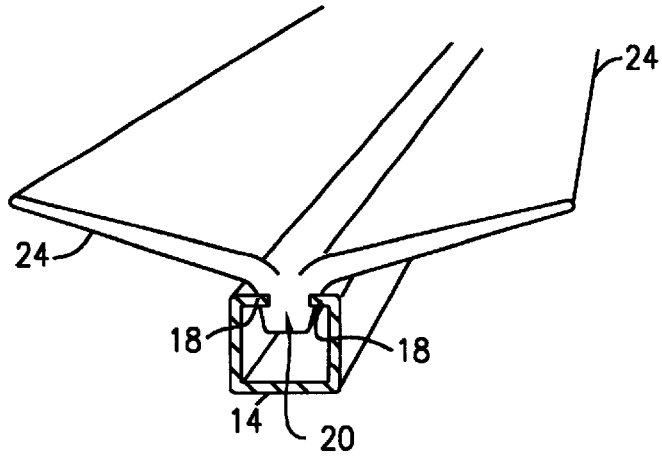
Figure 6:
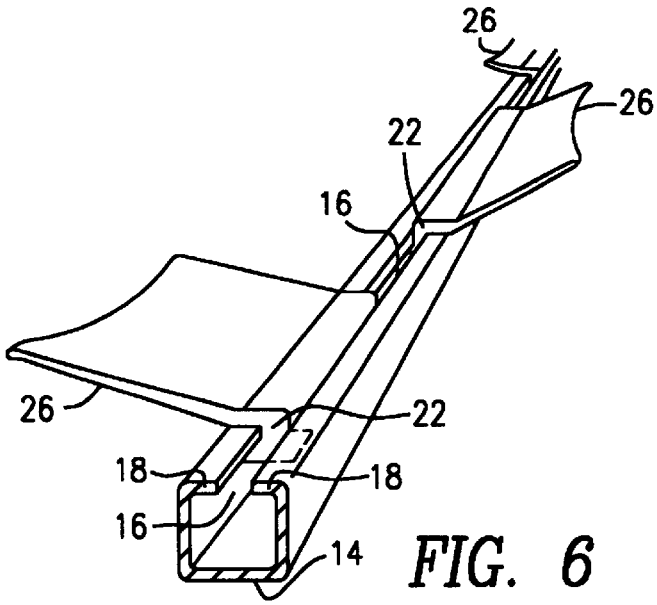
Figure 7:
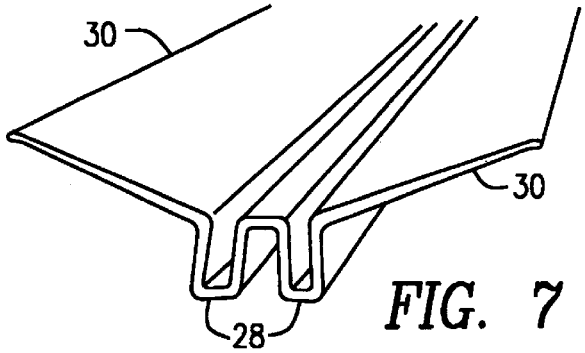

FIGS. 5 and 6 show spring bridges in which the supporting element and main, load-bearing bridge are separate parts. In the case of both designs, the main, load-bearing bridge is a hollow profiled bar 14, for example made of glass-fiber reinforced plastic, with a longitudinal flute 16. The longitudinal flute 16 and the wall webs 18 adjacent to it form an undercut groove into which it is possible to push a retaining web 20 or 22, respectively, formed on the respective supporting element. In FIG. 5 two wing-like lips 24 are combined to form a single supporting element in the form of a shallow V, whereas in FIG. 6 a plurality of wing-like supporting elements 26 are arranged one behind the other in the manner of segments in the longitudinal direction of the spring bridge 2. In both cases, the wing-like lips 24 of FIG. 5 and the plurality of supporting elements 26 of FIG. 6 are each cantilevered from the main bridge 14, whereby they have a fixed side proximate to the main bridge 14 and a free side that extends remotely from the main bridge 14. In the case of FIG. 6, it is possible for the supporting elements 26 to be introduced in different arrangements, for example—as is shown—aligned in an alternating manner or all on the same side or else in groups on one side and then again on the other side, for example two on the left, two on the right etc. It is likewise possible for the spacings between the supporting elements 26 to be selected freely, with the result that a design of this type provides in total many possible ways of configuring the spring bridge 2 in a variable manner.

Further design variants of the spring bridge according to the invention are shown in FIGS. 7 to 12. According to FIG. 7, the main, load-bearing bridge is designed as a profiled bar 28 which is folded a number of times in the transverse direction and on the lateral outer webs of which a wing-like supporting element 30 is integrally formed in each case extending in cantilever fashion from the profiled bar 28. The multiple folding of the profiled bars 28 is expedient from two aspects. On the one hand, the multiple folding improves the load-bearing capacity of the main, load-bearing bridge in the longitudinal direction; on the other hand, the main, load-bearing bridge can be deformed to a certain extent in the transverse direction via a bearing force acting on the supporting elements 30, and thus provides an additional contribution to the spring properties of the supporting elements 30.

Figure 8:
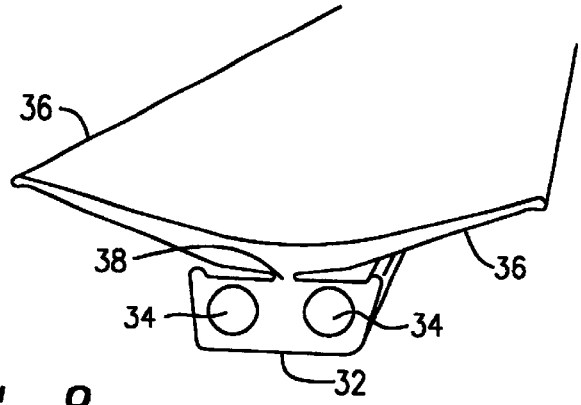

In the case of the design shown in FIG. 8, the main, load-bearing bridge comprises a solid bar 32 which is of slightly trapezoidal cross section and is provided with two longitudinal bores 34. Two wing-like supporting elements 36, which are combined to give a part in the form of a shallow V, are provided on the top side of the main, load-bearing bridge via a web 38, which serves as a spacer element. This arrangement advantageously permits an additional graduation in the spring properties of the supporting elements 36. This is because if the supporting element 36, which is spaced apart above the bar 32, is loaded by a bearing force, then, following a first, partial bending, it strikes against the bar 32 by way of its underside. For further bending, the bending path is thus shortened and the flexibility of the supporting element 36 is reduced as a result. It is noted that the wing-like supporting elements 36 are cantilevered from the bar 32 beginning at the web 38.

Figure 9:
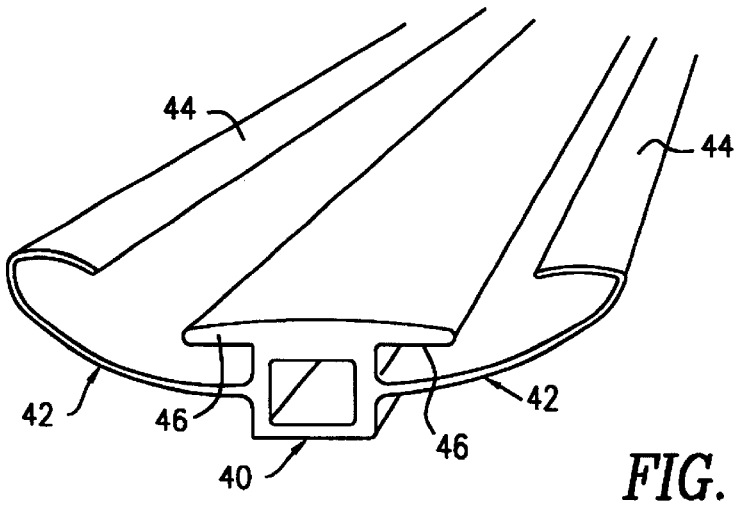

According to FIG. 9, slightly upwardly bent supporting elements 42 which are of sheet-like design are integrally formed on the sides of a hollow profiled bar 40, serving as main, load-bearing bridge, and, on their longitudinal edge remote from the hollow profiled bar 40, each bear a sheet-like, essentially horizontally extending bearing element 44. In addition, the top side of the hollow profiled bar 40 is broadened by laterally extending webs 46.

Figure 10:
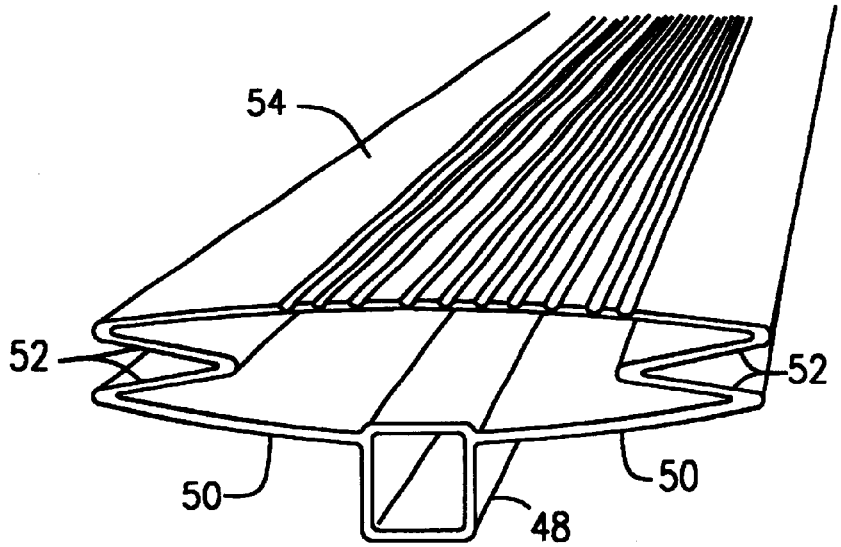

The spring bridge which is illustrated in FIG. 10 likewise has a hollow profiled bar as the main, load-bearing bridge, in this case designated by 48. Integrally formed on the bar 48 are two lips 50 which each extend outwards on one of the two longitudinal sides of the hollow profiled bar 48 and, on their outer edge, each bear an upwardly projecting spring element 52 in the form of a flexible V profile. The two spring elements 52, for their part, support a sheet-like bearing element 54. In the case of this design, the spring properties are advantageously obtained from the interaction of the different degrees of elasticity of the bearing element 54, of the spring elements 52, of the lips 50 and of the hollow profiled bar 48.

Figure 11:
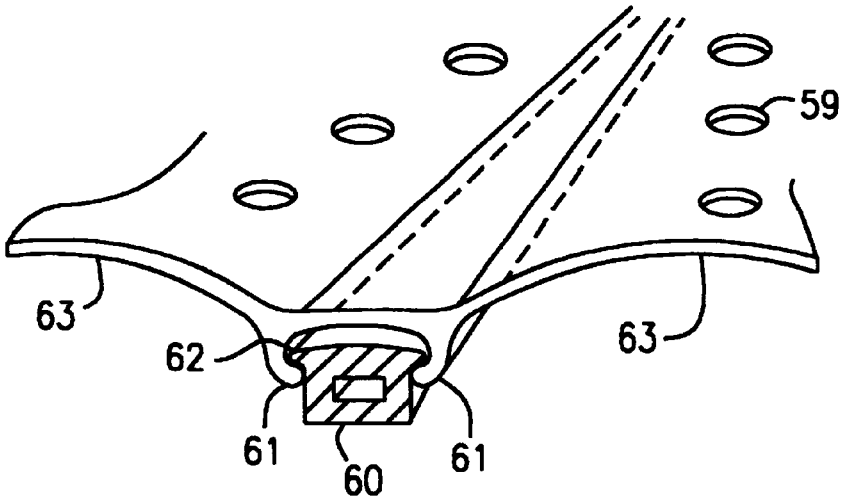

FIG. 11 has a further profiled bar, which is designated 60, specifically a hollow profiled bar for realizing a spring bridge. The bar 60 may have means which make it possible to attach supporting elements by means of a snap-action connection (clip). The corresponding means may be grooves, channels or flutes or, as in the case depicted, projecting edges, noses 62 or resilient lugs. A supporting element or a bearing 63, in this case dimensioned to be of a comparatively large surface area, is connected to a snap-on profile of approximately U-shaped cross section. In the embodiment depicted, which is to be understood as an example, the snap-on profile has a more or less flat sheathing part 64 (see FIG. 12). The bearings 63 and snap-on profiled are attached to the bar 60 in such a way that each bearing 64 is cantilevered from the bar 60. The elasticity properties of sheathing part 64 are coordinated with those of the snap-action edges 61, with the result that the bearing 63 can easily be clipped onto, and fastened reliably on, the profiled bar 60. As has been described above, bearing 63 may extend freely or else be of a large surface area and be connected to a plurality of profiled bars 60, if appropriate only partially or in certain regions. The formation of the ventilation openings 59 assists the necessary ventilation of the mattress. At the same time, the elasticity behavior of the bearing 63 can be adjusted as a result. By means of the abovementioned snap-on connection, it is also possible for individual bearing elements to be provided on the spring bridges.

Figure 12:
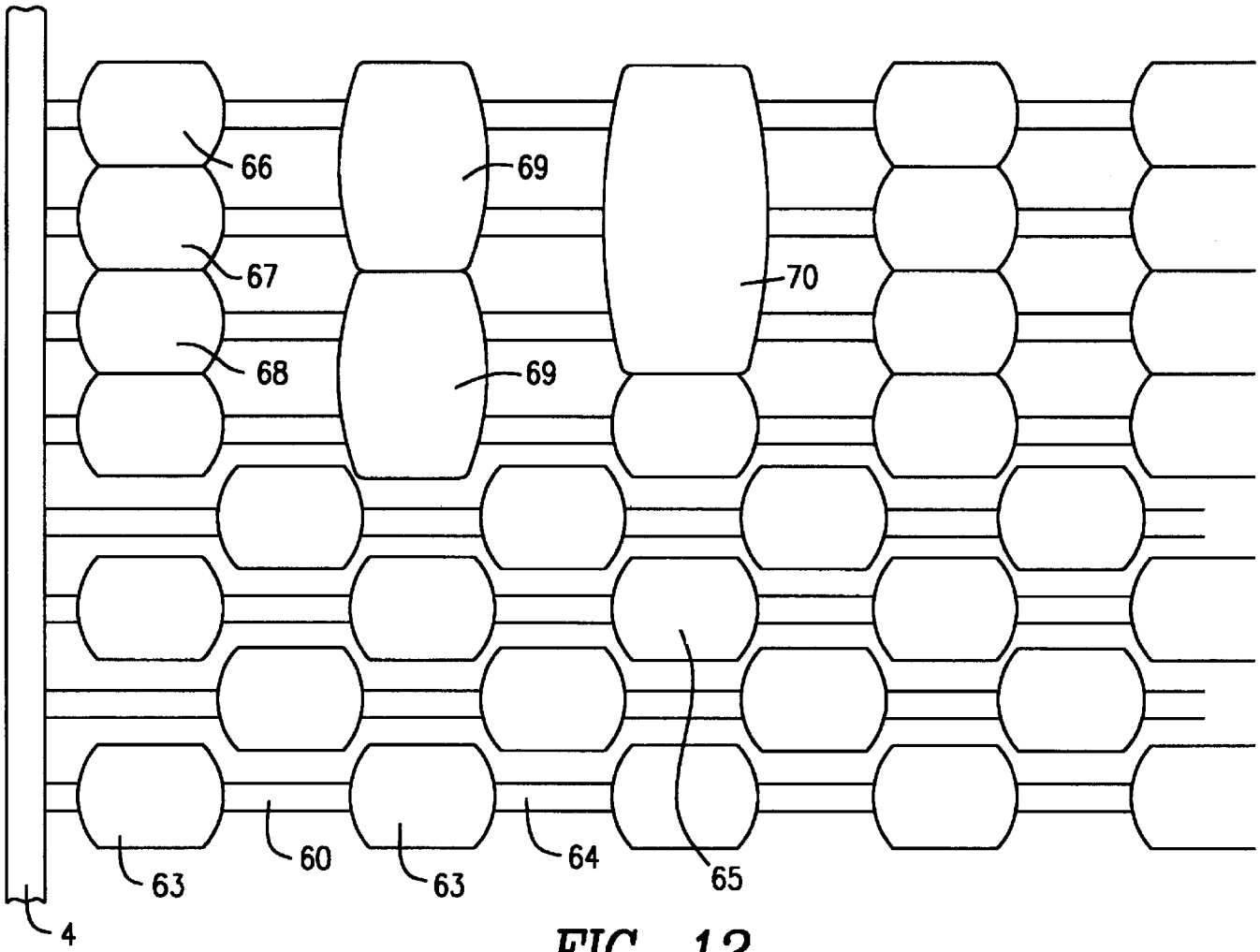

As FIG. 12 shows in a plan view, likewise flexible bearing elements 63; 64; 65; 66; 67; 68 of relatively small surface area can be clipped onto the spring bridges or profiled bars 60 in a state in which they are offset with respect to one another or in the immediate vicinity of one another, with the result that locally different elasticity behaviour of the mattress base can be adjusted in accordance with individual specifications. The effectiveness of the intended ventilating function is not restricted to an impermissible extent in this case. Supporting elements may be produced in different degrees of hardness and may be distinguished from one another, for example, by different colorings. The surfaces of the supporting elements may be configured, without high outlay, by means of decoration, a logo or the like. Supporting elements 69 are provided for fastening on in each case two profiled bars 60 and may likewise be clipped on optionally in a transversely offset state. The profile of the supporting elements may be configured in a variety of different forms and has, for example, a more or less flat cross section or a closed contour, similarly to the case shown in FIG. 10. In a comparable manner, supporting elements 70 are clipped, by way of two or more snap-on profiles, onto at least two, if appropriate also three or more, profiled bars 60, depending on the elasticity behaviour intended. The different supporting elements mentioned above each have a standardized snap-on profile. A combination of different supporting elements means that the flexibility values of a mattress base can be varied locally and adapted to individual requirements in a variety of different ways.

What is claimed is:

1. A spring bridge, comprising:

a main, load-bearing bridge having a longitudinal axis and a top side; and at least one supporting element attac he d to said main bridge , said at least one supporting element having a sheet-like shape which extends laterally away from said longitudinal axis of said main bridge, and is cantilevered from said main bridge, said at least one supporting element having an unloaded state, at least a portion of said at least one supporting element extending above said top side of said main bridge when in said unloaded state, and said at least one supporting element being designed such that it bends in a downward direction when a bearing force is exerted thereon, wherein a portion of said at least one supporting element located adjacent to said main bridge bends downward forming a first angle and wherein a portion of said at least one supporting element located remotely from said main bridge bends downward forming a second angle, said first angle being no greater than said second angle.

2. A spring bridge according to claim 1, wherein said main bridge has a first flexibility and said at least one supporting element has a second flexibility, said second flexibility being greater than said first flexibility.

3. A spring bridge according to claim 24, wherein a first supporting element is positioned on one side of said longitudinal axis of said main bridge and wherein a second supporting element is positioned on an opposite side of said longitudinal axis of said main bridge.

4. A spring bridge according to claim 1, wherein said main bridge and said at least one supporting element are plastic.

5. A spring bridge according to claim 4, wherein said main bridge has a hollow rectangular cross section.

6. A spring bridge according to claim 1, wherein said at least one supporting element is a wing-like lip cantilevered from said main bridge.

7. A spring bridge according to claim 29, wherein said main bridge has a hollow rectangular cross section.

8. A spring bridge according to claim 1, wherein said at least one supporting element includes a plurality of supporting elements spaced apart along said longitudinal axis of said main bridge.

9. A spring bridge according to claim 1, wherein said at least one supporting element is attached to said main bridge by at least one snap-action device.

10. A spring bridge according to claim 9, wherein said at least one snap-action device includes a profiled strip having a U-shaped cross section.

11. A spring bridge according to claim 10, wherein said main bridge includes a latch-in seat for said at least one snap-action device.

12. A spring bridge according to claim 1, wherein said latch-in seat is a groove.

13. A spring bridge according to claim 42, wherein said latch-in seat is an undercut.

14. A first spring bridge according to claim 8, wherein said plurality of supporting elements constitutes a first set of supporting elements, each supporting element of said first set of supporting elements extending in a direction transverse to said longitudinal axis of said main bridge and being aligned with an adjacent supporting element of a second set of supporting elements attached to another load-bearing bridge, which extends generally parallel to said main bridge along one side thereof.

15. A first spring bridge according to claim 8, wherein said plurality of supporting elements constitutes a first set of supporting elements, each supporting element of said first set of supporting elements extending in a direction transverse to said longitudinal axis of said main bridge and being offset in relation to an adjacent supporting element of a second set of supporting elements attached to another load-bearing bridge, which extends generally parallel to said main bridge along one side thereof.

16. A first spring bridge according to claim 8, wherein said plurality of supporting elements constitutes a first set of supporting elements, each supporting element of said first set of supporting elements having a first portion and a second portion, said first portion extending in a first direction transverse to said longitudinal axis of said main bridge and being aligned with an adjacent supporting element of a second set of supporting elements attached to another load-bearing bridge, which extends generally parallel to said main bridge along one side thereof, and said second portion extending in a second direction, opposite to said first direction, transverse to said longitudinal axis of said main bridge and being offset in relation to another adjacent supporting element of a third set of supporting elements attached to yet another load-bearing bridge, which extends generally parallel to said main bridge along an opposite side thereof.

17. The spring bridge according to claim 5, wherein said main bridge and said at least one supporting element are produced as one piece.

18. The spring bridge according to claim 7, wherein said main bridge and said at least one supporting element are produced as one piece.

19. The spring bridge according to claim 1, wherein said at least one supporting element is attached to said top side of said main bridge by a spacer element, whereby said at least one supporting element, when bent downward by the bearing force, contacts said top side of said main bridge, thereby reducing the flexibility of said at least one supporting element.

20. The spring bridge according to claim 19, wherein said main bridge and said at least one supporting element are produced as one piece.

21. The spring bridge according to claim 6, wherein said main bridge and said at least one supporting element are produced as one piece, and wherein said main bridge is folded at least once along said longitudinal axis.

22. The spring bridge according to claim 3, wherein said main bridge and said at least one supporting element are separate pieces, said at least one supporting element including a retaining web, said main bridge including an undercut groove sized and shaped to receive said retaining web.

23. The spring bridge according to claim 22, wherein a plurality of supporting elements are arranged in an alternating manner along said longitudinal axis of said main bridge.

* * * * *

UNITED STATES PATENT AND TRADEMARK OFFICE

CERTIFICATE OF CORRECTION

PATENT NO. : 6,256,815 B1
DATED : July 10, 2001
INVENTOR(S) : Hugo Degen

It is certified that error appears in the above-identified patent and that said Letters Patent is hereby corrected as shown below:

Title page,
Add the following information:
-- [30] Foreign Application Priority Data
March 20, 1996 [EPO] 96810175.8 --

Signed and Sealed this

Twenty-eighth Day of October, 2003

JAMES E. ROGAN
*Director of the United States Patent and Trademark Office*